United States Patent [19]

Takahashi

[11] Patent Number: 4,831,784

[45] Date of Patent: May 23, 1989

[54] POLISHING APPARATUS FOR END FACES OF OPTICAL FIBERS

[75] Inventor: Mitsuo Takahashi, Matsudo, Japan

[73] Assignee: Seikoh Giken Co., Ltd., Matsudo, Japan

[21] Appl. No.: 172,322

[22] Filed: Mar. 23, 1988

[30] Foreign Application Priority Data

May 29, 1987 [JP] Japan ..... 62-135800

[51] Int. Cl.[4] ..... B24B 5/00

[52] U.S. Cl. ..... 51/131.1; 51/131.4; 51/119

[58] Field of Search ..... 51/131.1, 131.3, 131.4, 51/283 R, 216 LP, 281 R, 237 M, 124 R, 90, 103 R, 119, 165.77, 236

[56] References Cited

U.S. PATENT DOCUMENTS

| | | | |
|---|---|---|---|
| 2,945,330 | 7/1960 | Peyches | 51/283 |
| 3,857,123 | 12/1974 | Walsh | 51/131.4 |
| 4,513,537 | 4/1985 | Spurling et al. | 51/216 |

*Primary Examiner*—Frederick R. Schmidt
*Assistant Examiner*—Maurina Rachuba
*Attorney, Agent, or Firm*—Spencer & Frank

[57] ABSTRACT

An apparatus for polishing end faces of optical fibers so that they are each given a convex spherical surface. The optical fibers are mounted on a jig so that their end faces are pressed against a polishing film attached to a rotary disk. The polishing film is made of a flexible (or cushionable) soft material having a Shore hardness of 10 through 100, such as synthetic rubber. The jig performs an orbital motion without rotation on its own axis.

14 Claims, 3 Drawing Sheets

POLISHING APPARATUS FOR END FACES OF OPTICAL FIBERS

BACKGROUND OF THE INVENTION

The present invention relates to a polishing apparatus for polishing end faces of optical fibers mounted on their ferrules, and more particularly, to a high production polishing apparatus for polishing end faces of optical fibers to give them high quality convex spherical surfaces.

A connection between optical fibers for optical communication is accomplished by using a disconnectable optical connector or, for a permanent connection, an optical splicer. If the end faces of optical fibers are polished to have convex spherical surfaces and thereafter connected to each other, the return loss due to a reflection at the connection point can be reduced. Such a return loss due to reflection especially affects high-speed mass communication and therefore it is desirable to perform the convex spherical polishing of the end faces of optical fibers for this type of communication.

Heretofore, the convex spherical polishing for the end faces of optical fibers mounted on their ferrules has been carried out by using a rotary polishing disk formed with a concave spherical surface. The end faces of optical fibers mounted on their ferrules are pressed against the concave spherical surface with polishing powder therebetween and then are moved so that they are given polished convex spherical surfaces.

This conventional polishing method has a problem in that the end face of a ferrule has a relatively small curvature of the order on several centimeters, and therefore the effective polishing area of the polishing disk is limited to a very small dimension. Therefore, it is difficult to increase the polishing efficiency with this type of polishing method. For example, it takes about 30 to 60 minutes for one polishing step even when the polishing process is proceeding properly.

The conventional polishing method has another problem in that harmful substances consisting of a mixture of polishing dust, polishing liquid and polishing powder exist on the polishing disk and are often forced into the polishing disk so that they become buried. It is difficult to remove or clean such harmful substances from the polishing disk in view of the structure of the conventional polishing apparatuses. While it is necessary that the polishing powder be distributed evenly and uniformly and the surface roughness of the polishing disk be kept within a predetermined value, the harmful substances which become trapped in the polishing disk affect the reproducibility of the polishing quality.

Accordingly, the polishing process often needs to be repeated until a satisfactory result is obtained, thereby lowering the productivity of the polishing process. The conventional polishing process also requires skilled people for carrying this process.

It is an object of the present invention to provide a polishing apparatus capable of easily polishing end faces of optical fibers to give them convex spherical surfaces such that this process has good reproducibility of the polishing quality and does not require skilled labor to carry out the process.

SUMMARY OF THE INVENTION

A polishing apparatus for end faces of optical fibers according to the present invention comprises: a rotatable polishing disk having a disk member made of a flexible (or cushionable) soft material and a polishing film provided on the disk member; a jig for mounting thereon a plurality of ferrules to which optical fibers are fixed; a mechanism for enabling the jig to effect an orbital motion without rotation of the jig on its own axis; and a mechanism for enabling the jig to be pressed against the polishing film with a predetermined pressure. In addition, the position of the rotational axis of the polishing disk may also effect an orbital motion.

In the present invention, the lower end surface of the ferrule is pressed against the rotatable polishing disk and the ferrule effects the polishing via an orbital motion without rotation on its own axis. The resultant ends of the fibers following polishing have a convex spherical surface. This prevention allows a polishing film on a disk having a diameter as large as several hundred millimeters to be used in contrast to the conventional polishing film which uses the concave polishing disk having a diameter of in the tens of millimeters. As a result, the amount of harmful substances left on the polishing surface per unit area is considerably and removal of these substances can be carried out without stopping the apparatus. Accordingly, the best polishing condition may be maintained thereby sufficiently improving the reproducibility of the polishing quality.

In addition, the polishing film is inexpensive and thus can be disposed after use. Therefore, this avoids the need for the expensive concave polishing disk previously used and any skilled labor to operate the device.

In addition, while the conventional polishing method has the limitation that the number of the ferrules which can be mounted on a jig at a time is limited by the shapes of the concave polishing disk, the present invention allows many ferrules to be mounted on the polishing surface so that many ferrules can be mounted on any jig design that may be selected.

DETAILED DESCRIPTION OF THE PREFERRED EMBODIMENTS

Figure 2:
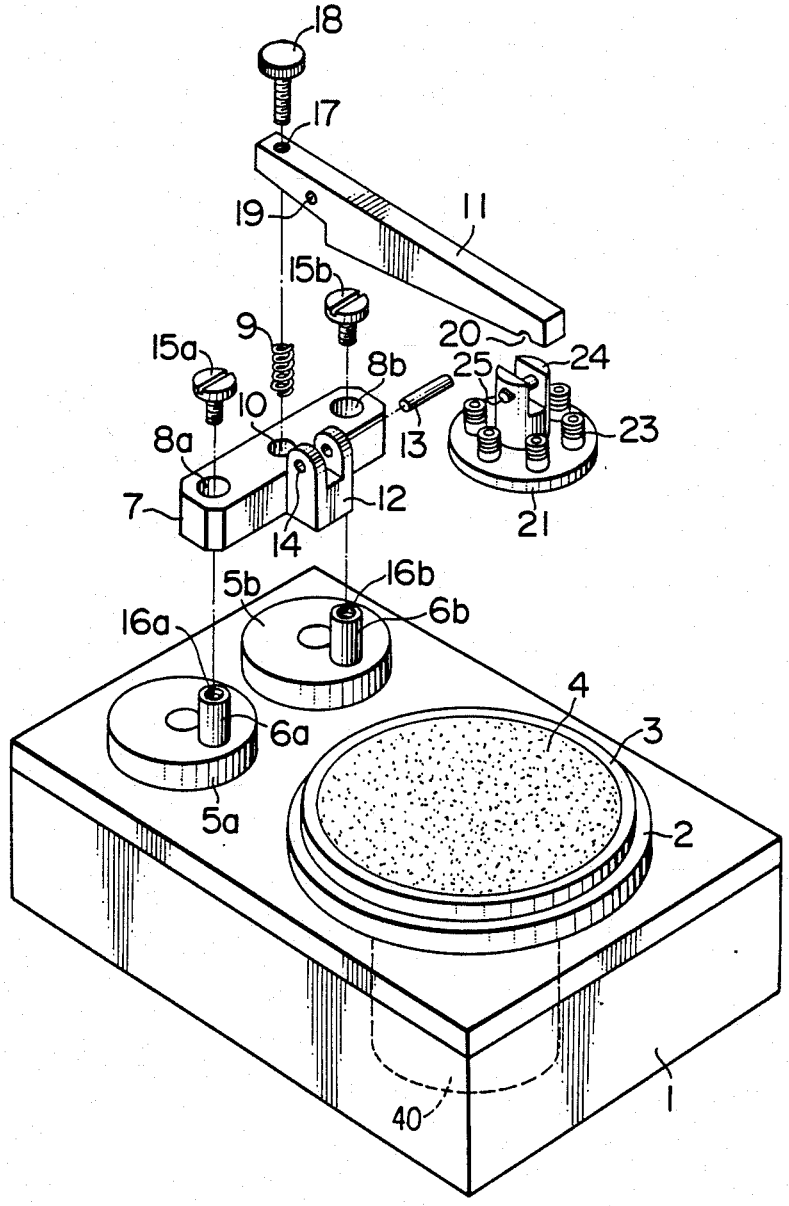
FIG. 2 is an exploded perspective view of the embodiment shown in FIG. 1.

Referring now to FIG. 2, the structure of the polishing apparatus according to the present invention will be described.

A body frame 1 is provided with a rotary disk 2 having a diameter of 170 mm, which is rotated at a speed of 0.5 rpm by a very low-speed electric motor 40 provided in the frame 1.

On the rotary disk 2, a rotary member 3 having a diameter of 160 mm is exchangeably mounted. To provide a polishing disk, a polishing film 4 having a diameter of 150 mm is attached to the rotary member 3. The rotary disk 2 is made of a flexible (or cushionable) soft material having a Shore hardness of 10 to 100. Examples of exemplary materials for disk 2 include synthetic rubber, hard cardboard and thick leather. Types of fine-grain polishing powder of the polishing film 4 are made for example of $Al_2O_3$, SiC, diamon or the like. The grain size thereof is about 15 microns.

The body frame 1 is provided near the outer periphery of the rotary disk 2 with two other rotary members 5*a* and 5*b*. On the upper surfaces of the rotary members 5*a* and 5*b* are fixed respectively eccentric shafts 6*a* and 6*b* at certain distances from the rotational centers of the rotary members 5*a* and 5*b*. The rotary members 5*a* and 5*b* are synchronously rotated by one or two electric motors (not shown) provided in the body frame 1 with a speed of 60 rpm.

An orbital connection member 7 is formed with two through holes 8*a* and 8*b* which are adapted to be brought into sliding contact with the outer peripheral surfaces of the eccentric shafts 6*a* and 6*b*. The central portion of the orbital connection member 7 is formed with a receiving hole 10 for receiving therein a compression coil spring 9. On one side of the orbital connection member 7 is fixed a bracket 12 for pivotally supporting an arm 11. The bracket 12 is formed with pin holes 14 for a pin 13.

Two set screws 15*a* and 15*b* engage with threaded holes 16*a* and 16*b* formed in the eccentric shafts 6*a* and 6*b* to prevent the orbital connection member 7 from coming off the eccentric shafts 6*a* and 6*b*.

One end of the arm 11 is formed with a threaded through hole 17 which is adapted to receive and engage a pressure regulating screw 18. The lower end of the pressure regulating screw 18 is brought into contact with one against the compression coil spring 9. The side wall of the arm 11 is formed with a through pin hole 19, so that the arm 11 can be pivotally mounted on the bracket 12 by the pin 13. The lower surface of a tip of the arm 11 is formed with a groove 20 having a semicircular cross section such that be a jig 21 fitted from below.

The jig 21 is used for holding ferrules 22 (see FIG. 1) and in the illustrated example had six adapters 23 fixed thereto. The center of the jig 21 is provided with a cylindrical portion 24 whose center contains a recess. An engage pin 25 lies horizontally across the recess so that it can be fitted into the groove 20 of the arm 11.

Figure 1:
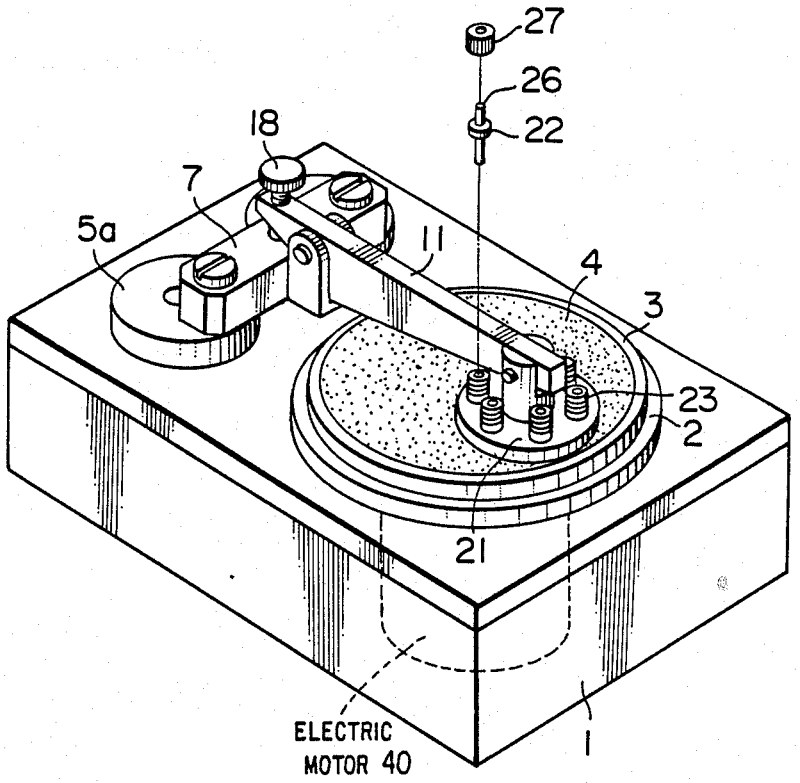
FIG. 1 is a perspective view showing one embodiment of a polishing apparatus for end faces of optical fibers according to the present invention.

Referring next to FIG. 1 showing the perspective view of the apparatus, the operation of this polishing apparatus will be described. First, the jig 21 is detached from the arm 11. Each of ferrules 22 is fixedly mounted to an optical fiber 26 and then they are mounted on the adapters 23 of the jig 21 by any type of mounting means. In FIG. 1, a mounting member 27 having a threaded inner surface is fitted over the ferrule 22 and thereafter is engaged with a threaded outer surface of the adapter 23, thus completing the mounting of the ferrules on the jig 21. The ferrule 22 is mounted so that its lower end protrudes about 0.2 to 0.8 mm from the lower surface of the jig 21. After all six of the ferrules 22 are mounted, the tip of the arm 11 is lifted and the engage pin 25 of the jig 21 is fitted from below into the groove 20 of the arm 11.

Next, the rotary members 5*a* and 5*b* are rotated to enable the eccentric shafts 6*a* and 6*b* to effect a synchronous rotation thereby causing the orbital connection member 7 to perform a whirling motion. This motion is transmitted through the arm 11 to the jig 21, so that the jig 21 performs a circular orbital motion in an orbital path which leaves a circular trace.

When the pressure regulating screw 18 provided on the arm 11 is advanced into the hole 17, the compression coil spring 9 is compressed so that the tip of the arm 11 is biased downwardly. Accordingly, the polishing pressure acting upon the lower end of the ferrule 22 is regulated depending upon the position of pressure regulating screw 18.

Under this condition, the lower end surfaces of the ferrules 22 are pressed against the polishing film 4. Since the polishing film 4 is attached to the disk member 3 which is made of the flexible (or cushionable) soft material mentioned before, the film 4 can be deformed in a manner such that it can yield to achieve concave shapes along the lower end faces of the ferrules 22. Each of the ferrules 22 is moved in the circular orbital motion thereby leaving the circular trace decribed above. During the initial stage of polishing, the maximum contact pressure acts upon the outer edge of the lower end surface of the ferrule 22. Accordingly, a portion of the optical fiber near this outer edge is polished and removed first and the polishing action then gradually advances toward the center of the optical fiber. Finally, the end face of the optical fiber is polished to have a convex spherical surface having an appropriate curvature. The curvature is determined by the amount of the ferrule protrusion, the shape of the end face of the ferrule, the hardness, the thickness of the disk member 3 and so on.

It is preferable for the convex spherical polishing action is uniformly advanced towrd the center of the end face of the optical fiber from all directions; that is, through 360 degrees. For this reason, the present invention has the feature that the ferrule is held so that it will not rotate on its own axis and the polishing will be performed by a circular orbital motion.

Furthermore, the rotary disk 2 is rotated with a very low speed, so that the sliding surface between the polishing film 4 and the lower end surface of the ferrule 22 is always kept in a good polishing condition.

Figure 3:
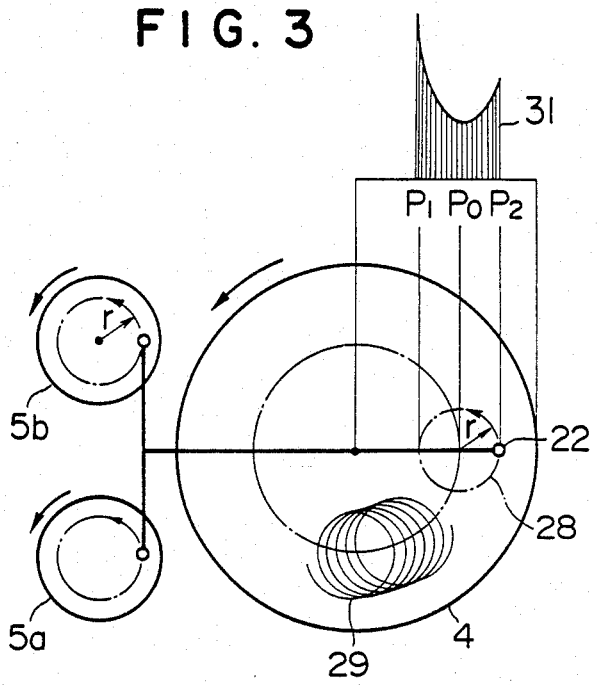
FIG. 3 is an explanatory view showing a ferrule trace by the embodiment shown in FIG. 1 and an amount of wear of the polishing film.

Further, in another embodiment of the present invention, the rotation axis of the rotary disk 2 effects also an orbital motion. The effect of this structure will be described referring to FIG. 4. FIG. 3 is an explanatory view showing the polishing trace in the embodiment shown in FIG. 1. When the rotary members 5*a* and 5*b* are synchronously rotated with a radius r, each ferrule 22 leaves a circular trace 28 having a radius r. Further, when the polishing film 4 is rotated, the circular trace 28 forms continuous circles 29 on the polishing film 4. Under these conditions, the polishing film 4 wears always at the same region, so that the amount of wear becomes as shown in the wear graph 31 of this figure. That is, the amounts of wear at both ends $P_1$ and $P_2$ are greater than at the center $P_0$, so that the polishing film 4 is deteriorated earlier in these regions $P_1$ and $P_2$.

Figure 4:
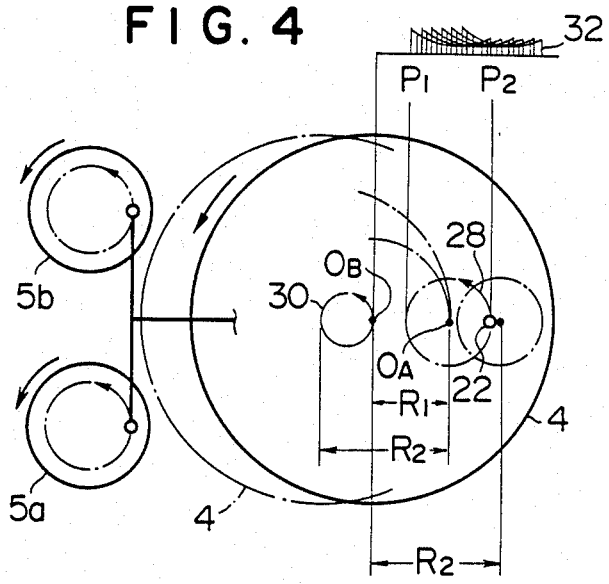
FIG. 4 is a view similar to FIG. 3 showing a ferrule trace an amount of wear of the polishing film according to another embodiment of the present invention.

FIG. 4 shows the embodiment in which the rotation axis of the rotary disk effects the orbital motion. That is, the polishing film 4 effects on orbital motion as well rotation on its own axis. The center point $O_B$ of the rotation of the polishing film on its own axis leaves a circular orbital trace 30. It should be noted that each ferrule 22 always leaves a circular trace 28 on the same region, but the polishing film per se effects the orbital motion. In FIG. 4, the polishing film 4 at the rightmost position is depicted by a solid line, whereas at the leftmost position by a two-dot chain line. The distance between the center point $O_A$ of the ferrule orbital motion and the center point $O_B$ of the rotation of the polishing film on its own axis is $R_1$ at its minimum and $R_2$ at its maximum. Consider now the trace 28 of each of the ferrule as viewed from the polishing film 4. Assuming that the center point $O_B$ of the rotation of the polishing film on its own axis were kept at the shown position, the trace 28 of the ferrule would effect an oribtal motion on the polishing film 4 with the minimum distance $R_1$ from point $O_B$ and the maximum distance $R_2$ from the point $O_B$. As a result, the amount of wear of the polishing film 4 becomes as shown in the wear graph 32 of this figure. In the graph 32 it is shown that the amount of wear is approximately level. In addition, appropriate selection of the rotation speed of the rotary members 5*a* and 5*b* and the rotational speed as well as the speed of the orbital motion of the polishing film 4 enables the amount of wear of the polishing film 4 to be as uniformly level as possible.

What is claimed is:

1. An apparatus for polishing the end faces of optical fibers comprising:

a frame;

a rotatable polishing disk rotatably mounted to said frame, said rotatable polishing disk having a flexible disk member made of a soft material and a polishing film mounted thereon;

a jig including means for mounting thereon a plurality of ferrules, each of said ferrules being adapted to receive an optical fiber, said jig having a central axis;

means for moving said jig along an orbital path without rotation about said central axis, said means including:

a plurality of rotary members rotatably mounted on said frame, each said rotary member being adapted for rotational movement about a respective rotational axis, and each of said rotary members having an eccentric shaft displaced from each said respective rotational axis disposed thereon;

an orbital connection member mounted to said eccentric shafts, said orbital connection member including a bracket;

an arm pivotally supported by said bracket, said arm having a first end containing a tip which can be removably connected to said jig whereby rotation of said rotary members imparts an orbital motion to said orbital connection member via said arm to said jig; and means for applying a predetermined pressure through said jig to said polishing film, said means for applying a predetermined pressure including:

a resilient means mounted between said orbital connection member and said arm, whereby said resilient means applies an upward force on a second end of said arm to cause said first end to apply a downward force to said jig.

2. An apparatus as defined in claim 1, further comprising means for moving said polishing disk along an orbital path.

3. An apparatus as defined in claim 1, wherein said disk member has a Shore hardness between 10 and 100.

4. An apparatus as defined in claim 3, wherein said disk member is selected from a group consisting of synthetic rubber, hard cardboard and thick leather.

5. An apparatus as defined in claim 1, further comprising an electric motor for rotating said polishing disk.

6. An apparatus as defined in claim 5, wherein said electric motor is rotatable at approximately 0.5 rpm.

7. An apparatus as defined in claim 1, wherein said means for causing said jig to move in an orbital motion without rotation about said central axis comprises two said rotary members.

8. An apparatus for polishing the end faces of optical fibers comprising:

a frame;

a rotatable polishing disk rotatably mounted to said frame, said rotatable polishing disk having a flexible disk member made of a soft material and a polishing film mounted thereon;

a jig including means for mounting thereon a plurality of ferrules, each of said ferrules being adapted to receive an optical fiber, said jig having a central axis;

means for moving said jig along an orbital path without rotation about said central axis; and means for applying a predetermined pressure through said jig to said polishing film.

9. An apparatus as defined in claim 8, further comprising means for moving said polishing disk along an orbital path.

10. An apparatus as defined in claim 8, wherein said disk member has a Shore hardness between 10 and 100.

11. An apparatus as defined in claim 10, wherein said disk member is selected from a group consisting of synthetic rubber, hard cardboard and thick leather.

12. An apparatus as defined in claim 8, further comprising an electric motor for rotating said polishing disk.

13. An apparatus as defined in claim 12, wherein said electric motor is rotatable at approximately 0.5 rpm.

14. An apparatus as defined in claim 8, wherein said means for causing said jig to move in an orbital motion without rotation about said central axis comprises two rotary members.

* * * * *